US009423190B2

(12) United States Patent
Huazhao et al.

(10) Patent No.: US 9,423,190 B2
(45) Date of Patent: Aug. 23, 2016

(54) REFRIGERANT DISTRIBUTOR FOR HEAT EXCHANGER AND HEAT EXCHANGER

(75) Inventors: Liu Huazhao, Zhejiang (CN); Lin-jie Huang, East Amherst, NY (US)

(73) Assignees: Sanhua (Hangzhou) Micro Channel Heat Exchanger Co., Zhejiang Province (CN); Danfoss A/S, Nordborg (DK)

( * ) Notice: Subject to any disclaimer, the term of this patent is extended or adjusted under 35 U.S.C. 154(b) by 1507 days.

(21) Appl. No.: 12/751,311

(22) Filed: Mar. 31, 2010

(65) Prior Publication Data

US 2010/0252243 A1 Oct. 7, 2010

(30) Foreign Application Priority Data

Apr. 3, 2009 (CN) ..... 2009 1 0132009

(51) Int. Cl.
*F28F 9/02* (2006.01)
*F25B 39/02* (2006.01)

(52) U.S. Cl.
CPC ..... *F28F 9/0273* (2013.01); *F25B 39/028* (2013.01)

(58) Field of Classification Search
CPC ..... F28F 9/027; F28F 9/0273
USPC ..... 165/109.1, 174, 525, 52, 80.4; 361/699; 62/525, 527
See application file for complete search history.

(56) References Cited

U.S. PATENT DOCUMENTS 1,315,853 A * 9/1919 Nordling ..... F28F 13/12 138/38
1,662,236 A * 3/1928 Coupland ..... F24D 9/02 165/174
2,252,045 A * 8/1941 Spanner ..... 138/38
2,942,858 A * 6/1960 Stoneburner ..... F28D 7/12 165/142
3,026,092 A * 3/1962 Pellegrini ..... F28D 21/0008 165/110
3,232,341 A * 2/1966 Woodworth ..... F28B 1/00 165/109.1
3,826,304 A * 7/1974 Withers et al. ..... 165/179
3,976,128 A * 8/1976 Patel ..... F25B 39/02 165/153
5,743,111 A 4/1998 Sasaki et al.
5,806,586 A * 9/1998 Osthues ..... F28F 9/0273 165/153
6,363,965 B1 4/2002 Carmack et al.
6,729,386 B1 * 5/2004 Sather ..... F28D 1/05316 165/110
7,143,605 B2 * 12/2006 Rohrer ..... F25B 5/02 165/174
7,275,394 B2 * 10/2007 Lundberg ..... F28D 1/05391 165/DIG. 483
7,398,819 B2 * 7/2008 Taras ..... F25B 39/028 165/150
2002/0088611 A1 * 7/2002 Geissler et al. ..... 165/158
2002/0174978 A1 * 11/2002 Beddome ..... F28D 9/0043 165/174
2006/0108099 A1 * 5/2006 Huang et al. ..... 165/80.4
2008/0013278 A1 * 1/2008 Landry et al. ..... 361/699
2008/0093051 A1 * 4/2008 Rios ..... F25B 41/067 165/61

(Continued)

FOREIGN PATENT DOCUMENTS

CA 2289428 * 12/1999 ..... F58F 1/08
DE 102006016839 * 10/2007 ..... F28F 27/02

(Continued)

*Primary Examiner* — Leonard R Leo
*Assistant Examiner* — Gustavo Hincapie Serna
(74) *Attorney, Agent, or Firm* — McCormick, Paulding & Huber LLP

(57) ABSTRACT

A refrigerant distributor for a heat exchanger is disclosed. The refrigerant distributor comprises: a pipe for distributing a refrigerant, the pipe having a channel therein in which the refrigerant flows. The channel has at least one portion having reduced cross-section area. With the above configuration, the distributor relieves the layering of refrigerant flowing in a distributing pipe and mixes the vapor-liquid refrigerant relatively uniformly.

15 Claims, 6 Drawing Sheets

(56) References Cited

U.S. PATENT DOCUMENTS

2009/0244895 A1* 10/2009 Chen ..... 362/249.02
2009/0272536 A1* 11/2009 Burns et al. ..... 166/302

FOREIGN PATENT DOCUMENTS

EP 1798507 A2 6/2007
JP 2004278935 A 10/2004

* cited by examiner

REFRIGERANT DISTRIBUTOR FOR HEAT EXCHANGER AND HEAT EXCHANGER

CROSS REFERENCE TO RELATED APPLICATIONS

This application is entitled to the benefit of and incorporates by reference essential subject matter disclosed in Chinese Patent Application No. 200910132009.7 filed on Apr. 3, 2009.

BACKGROUND OF THE INVENTION

1. Field of the Invention

The present invention relates to a refrigerant distributor for a heat exchanger and a heat exchanger having the refrigerant distributor.

2. Description of the Related Art

A conventional micro-channel heat exchanger 20 generally comprises micro-channels or flat tubes 5, fins 4 disposed between the adjacent micro-channels or flat tubes 5, an inlet manifold 3 and an outlet manifold (not shown) disposed at ends of the micro-channels or flat tubes 5 respectively, and a refrigerant distributor 10 disposed in the inlet manifold 3 as shown in FIGS. 1-2. The refrigerant distributor 10 is disposed at a side of the heat exchanger 20 to distribute refrigerant. The distributor 10 may have a portion extending out of the inlet manifold 3 as shown in FIG. 1 or may have no portion extending out of the inlet manifold 3. The refrigerant distributor 10 comprises a pipe 9' in which a plurality of outlets 8 are formed in an axial direction of the pipe 9'.

If vapor-liquid phase refrigerant exists, distribution of the refrigerant shall be problematic. In order to distribute the vapor-liquid phase refrigerant, a refrigerant distributor 10 has been proposed as shown in FIG. 2. The distributor 10 is formed by a cylindrical pipe in which a plurality of outlets 8 are formed through a wall of the cylindrical pipe. Assuming that refrigerant enters into the distributor 10 from an inlet 7 shown in FIG. 2, the refrigerant flows along an inner chamber of the distributor, is ejected out of the pipe 9' through the outlets 8, and then is mixed in the inlet manifold 3. After that, the mixed refrigerant flows into the flat tubes 5. However, the distributor 10 illustrated in FIG. 2 is disadvantageous in that refrigerant is layered when it flows in the distributing pipe. The liquid refrigerant is located on a lower side and the gaseous refrigerant is located on an upper side due to the gravity.

SUMMARY OF THE INVENTION

It is an object of the present invention to provide a refrigerant distributor for a heat exchanger and a heat exchanger having the refrigerant distributor which can alleviate the layering of refrigerant flowing in a distributing pipe.

In accordance with an aspect of the present invention, there is provided a refrigerant distributor for a heat exchanger. The refrigerant distributor comprises: a pipe for distributing refrigerant. The pipe has a channel therein in which the refrigerant flows. The channel has at least one portion having reduced cross-section area, for example, between a first end and a second end of the pipe.

In accordance with another aspect of the present invention, the at least one portion having reduced cross-section area is a reducing segment formed by reducing a size of the pipe in a direction generally perpendicular to an axial direction of the pipe. The pipe may be a cylindrical pipe and the reduced size is a diameter.

In accordance with a further aspect of the present invention, the at least one portion having reduced cross-section area is a flat segment formed by pressing the portion of the pipe to be flat.

In accordance with a still further aspect of the present invention, the at least one portion having reduced cross-section area is a reducing segment formed by pressing an outer peripheral surface of the portion of the pipe.

In accordance with a further aspect of the present invention, the at least one portion having reduced cross-section area is formed by a raised portion projecting inward from an inner wall of the pipe.

In accordance with another aspect of the present invention, the pipe has an inlet disposed at an end of the pipe and the refrigerant flows into the pipe through the inlet. The at least one portion having reduced cross-section area comprises a plurality of portions having reduced cross-section area. Distances between the adjacent portions having reduced cross-section area of the plurality of portions having reduced cross-section area gradually increase from one end to the other end of the pipe.

In accordance with another aspect of the present invention, the at least one portion having reduced cross-section area comprises a plurality of portions having reduced cross-section area. Distances between the adjacent portions having reduced cross-section area of the plurality of portions having reduced cross-section area are generally equal.

In accordance with another aspect of the present invention, at least one outlet is disposed between every two adjacent portions having reduced cross-section area of the plurality of portions having reduced cross-section area such that the refrigerant flows out of the pipe through the at least one outlet. In accordance with an alternative aspect of the present invention, the pipe has a plurality of outlets through which the refrigerant flows out of the pipe, the at least one portion having reduced cross-section area comprises a plurality of portions having reduced cross-section area, and a plurality of the portions having reduced cross-section area such as two portions having reduced cross-section area are disposed between every two adjacent outlets of the plurality of outlets.

In accordance with another aspect of the present invention, there is provided a heat exchanger. The heat exchanger comprises a refrigerant distributor disposed at a side of the heat exchanger to distribute refrigerant, wherein the refrigerant distributor is one of the distributors mentioned above. The heat exchanger may be a micro-channel heat exchanger.

With the above configuration, the refrigerant distributor alleviates the layering of refrigerant flowing in a distributing pipe and mixes the vapor-liquid refrigerant relatively uniformly.

BRIEF DESCRIPTION OF THE DRAWINGS

These and/or other aspects and advantages of the present invention will become apparent and more readily appreciated from the following description of the embodiments, taken in conjunction with the accompanying drawing.

DETAILED DESCRIPTION OF THE EMBODIMENTS

Figure 1:
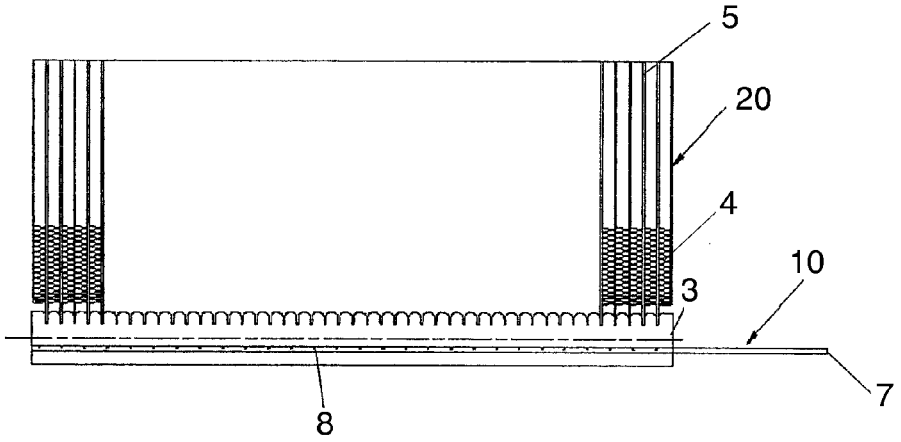
Fig. 1 Prior Art
FIG. 1 is a schematic view showing a conventional micro-channel heat exchanger.
Figure 2:
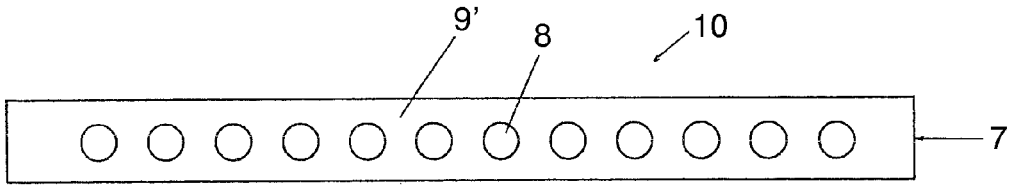
Fig. 2 Prior Art
FIG. 2 is a schematic view showing a conventional refrigerant distributor.

The embodiments are described below in order to explain the present invention, but do not pose a limitation on the scope of the invention.

Embodiment 1

A micro-channel heat exchanger 2 according to a first embodiment of the present invention comprises micro-channels or flat tubes 5, fins 4 disposed between the adjacent micro-channels or flat tubes 5, an inlet manifold 3 and an outlet manifold (not shown) disposed at ends of the micro-channels or flat tubes 5 respectively, and a refrigerant distributor 1 disposed in the inlet manifold 3 as shown in FIGS. 3-6. The refrigerant distributor 1 is disposed at a side of the heat exchanger 2 to distribute refrigerant.

The refrigerant distributor 1 for the heat exchanger comprises a pipe 9 for distributing refrigerant as shown in FIGS. 3-6. The pipe 9 has a channel 91 therein in which the refrigerant flows. The channel 91 has at least one portion having reduced cross-section area 6. The pipe 9 may be a cylindrical pipe. The pipe 9 further comprises a plurality of outlets 8 from which the refrigerant flows out of the pipe 9, and an inlet 7 through which the refrigerant flows into the pipe 9. At least one outlet 8 is disposed between every two adjacent portions having reduced cross-section area 6 of the plurality of portions having reduced cross-section area 6. Alternatively, one portion having reduced cross-section area 6, or a plurality of the portions having reduced cross-section area 6 such as two portions having reduced cross-section area are disposed between every two adjacent outlets 8 of the plurality of outlets 8.

The portions having reduced cross-section area 6 may be reducing segments 6 formed by reducing a size of the pipe 9 in a direction generally perpendicular to an axial direction of the pipe 9 as shown in FIGS. 3-6. The portions having reduced cross-section area 6 may be the reducing segments 6 formed by pressing an outer peripheral surface of the portions of the pipe 9. For example, a diameter D2 of segments of a cylindrical pipe 9 positioned at intervals in a longitudinal direction of the cylindrical pipe 9 is reduced to a predetermined diameter D1 to form the reducing segments 6 as an example of the portions having reduced cross-section area, that is, D2<D1. The outlets 8 are arranged through walls of the unreduced portions of the pipe 9.

Assuming that refrigerant enters into the distributor 1 through the inlet 7, the refrigerant is remixed every time it passes through one of the reducing segments 6. As a result, the vapor-liquid refrigerant is mixed uniformly. A part of the mixed refrigerant is passed out of the pipe 9 through the outlets 8 in the unreduced portions of the pipe 9, and the remaining refrigerant continues advancing and is remixed again when flowing through the next reducing segment. The refrigerant is mixed multiple times through the reducing segments to be more uniformly distributed.

In order that a vapor-liquid fluid flowing in the pipe 9 is sufficiently mixed before it arrives at the next outlet 8, two or more portions having reduced cross-section area 6 may be disposed between every two adjacent outlets 8 to remix the vapor-liquid fluid multiple times such that the vapor-liquid fluid is mixed uniformly when it flows out of the pipe through the outlets 8.

Figure 4:
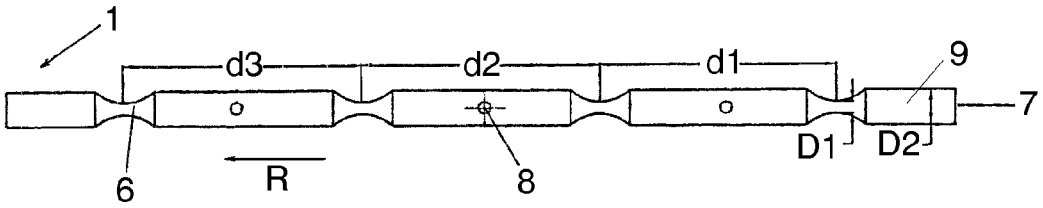
FIG. 4 is a schematic front view showing a refrigerant distributor according to the first embodiment of the present invention.

According to an example of the embodiment of the present invention, distances between the adjacent portions having reduced cross-section area may gradually increase from one end of the pipe, at which the inlet 7 is disposed, to the other end of the pipe, or the distances between the adjacent portions having reduced cross-section area may be generally equal. When a refrigerant passes through the reducing segments 6 in a refrigerant flow direction R in which the refrigerant flows in the pipe 9, pressure loss occurs. As shown in FIG. 4, the distances d1, d2, and d3 between the adjacent reducing segments may be given as d3≥d2≥d1. In other words, the distances become larger in the refrigerant flow direction, thereby reducing large pressure loss that is caused by excessive reducing segments through which the refrigerant passes due to excessive length of a distributor. The number of the reducing segments is not limited and may be determined according to actual conditions. Alternatively, the reducing segments may be arranged at generally equal intervals, that is, the distances d1, d2, and d3 between the adjacent reducing segments may be given as d1=d2=d3.

An example of a method of manufacturing the distributor is described below. Openings with a predetermined size as the outlets 8 are formed by punching at intervals through a wall of a common smooth cylindrical pipe. Then, reducing segments 6 are formed by pressing an outer peripheral surface of the cylindrical pipe at predetermined positions between the adjacent openings in such a way that a size of a cross-section of the pipe located at the predetermined positions is reduced to a required size.

The number of outlets 8 in each of the unreduced portions between the adjacent reducing segments 6 is not limited to one, but two or more outlets 8 may be disposed in each of the unreduced portions between the adjacent reducing segments 6. The specific positions of the openings may be any appropriate positions and are dependent upon specific conditions.

In the above embodiment, alternatively, the pipe may be a pipe having an elliptical cross-section, a flat pipe and the like instead of a cylindrical pipe. A cross-section shape of the pipe is not limited. The pipe may have any appropriate cross-section shape. In addition, the pipe is not limited to a straight pipe, but may be a pipe having any appropriate shape.

Figure 3:
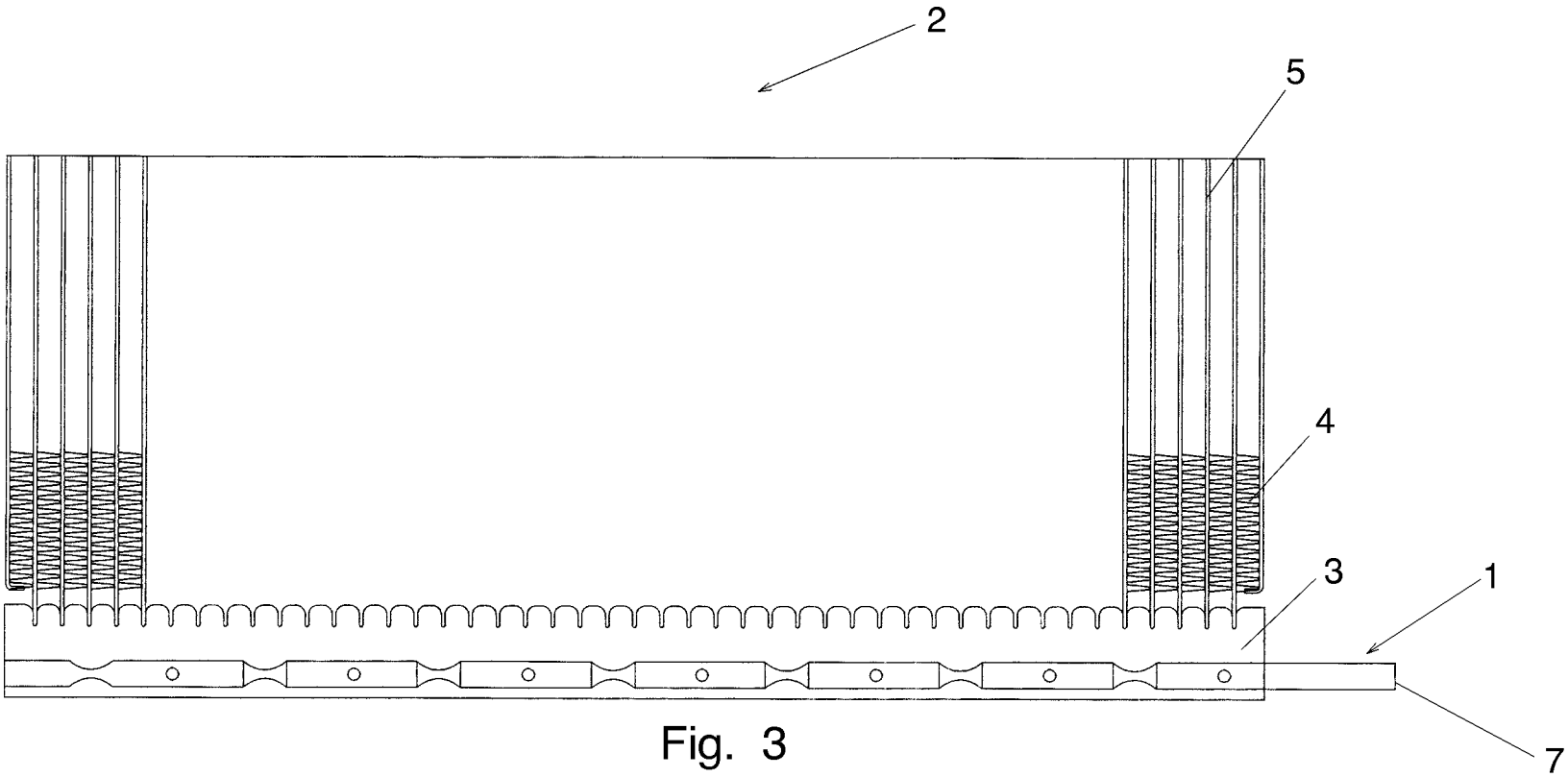
FIG. 3 is a schematic view showing a micro-channel heat exchanger according to a first embodiment of the present invention.
Figure 5:
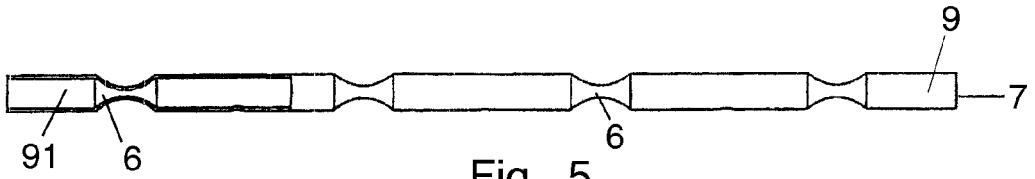
FIG. 5 is a schematic top view of the refrigerant distributor shown in FIG. 4.
Figure 6:
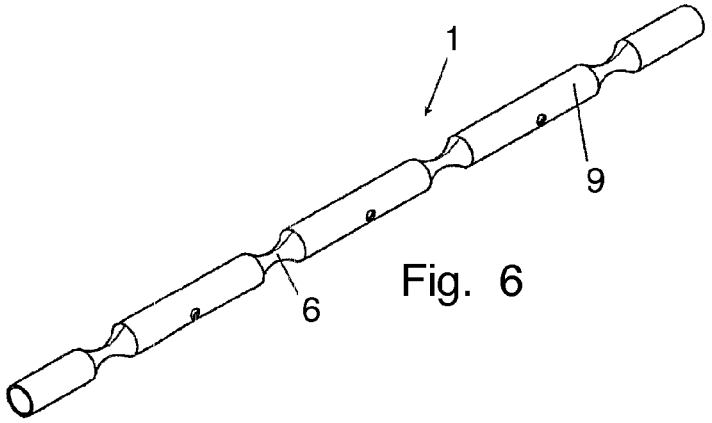
FIG. 6 is a schematic perspective view of the refrigerant distributor shown in FIG. 4.

The cylindrical pipe 9 shown in FIGS. 4-6 does not contain the portion extending out of the heat exchanger 2 as shown in FIG. 3.

Embodiment 2

A heat exchanger 2' according to a second embodiment of the present invention is the same as that of the first embodiment except a refrigerant distributor V. Only the distributor 1' is described below in detail.

The refrigerant distributor 1' comprises a cylindrical pipe 9 as shown in FIGS. 7-10. The pipe 9 comprises a plurality of outlets 8 through which the refrigerant flows out of the pipe 9. The distributor 1' according to the second embodiment is the same as the distributor 1 according to the first embodiment except that the flat segments 6' provided as an example of the portions having reduced cross-section area according to the second embodiment is different from the reducing segments 6 of the first embodiment. The portions having reduced cross-section area 6' are flat segments 6' formed by pressing the portions of the pipe to be flat. The flat segments 6' facilitate manufacturing of the distributor and may be formed in a flat duckbill shape as shown in FIGS. 7-10.

Figure 7:
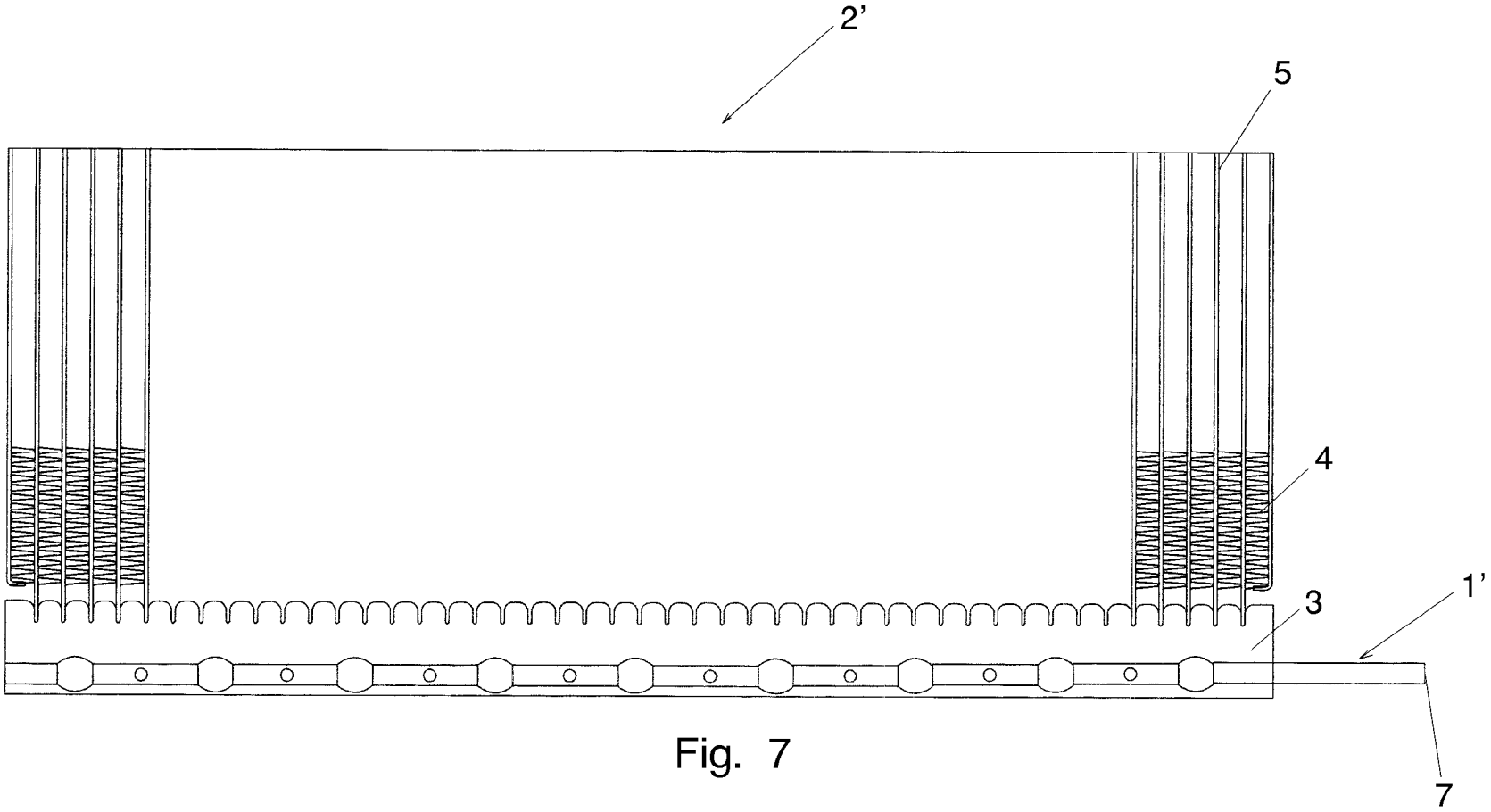
FIG. 7 is a schematic view showing a micro-channel heat exchanger according to a second embodiment of the present invention.
Figure 8:
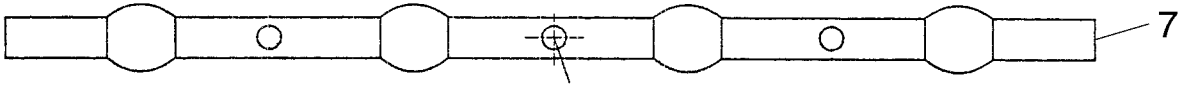
FIG. 8 is a schematic front view showing a refrigerant distributor according to the second embodiment of the present invention.
Figure 9:
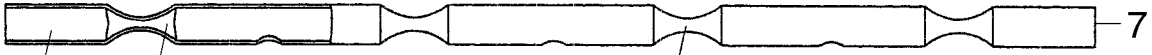
FIG. 9 is a schematic top view of the refrigerant distributor shown in FIG. 8.
Figure 10:
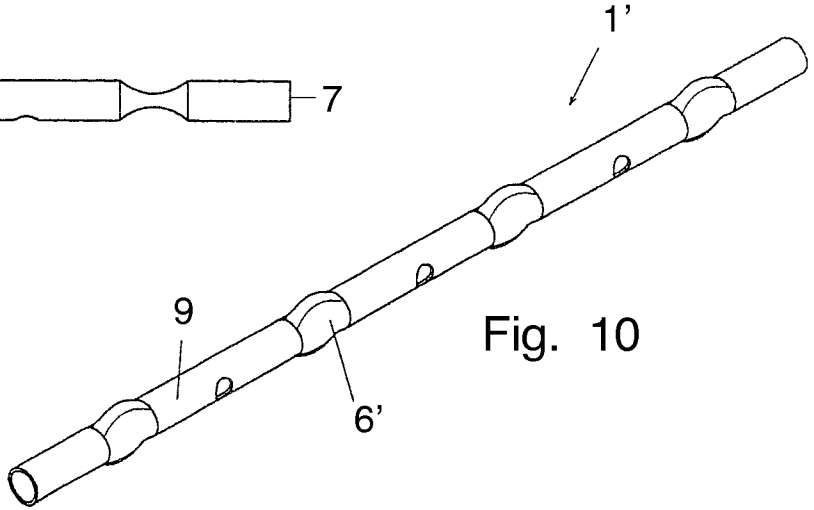
FIG. 10 is a schematic perspective view of the refrigerant distributor shown in FIG. 8.

The cylindrical pipe 9 shown in FIGS. 8-10 does not contain the portion extending out of the heat exchanger 2' as shown in FIG. 7.

Although the embodiments in which the distributor according to the present invention is used in the micro-channel heat exchanger have been described, the distributor according to the present invention can be applied to any other appropriate heat exchangers except of the micro-channel heat exchanger.

Figure 11:
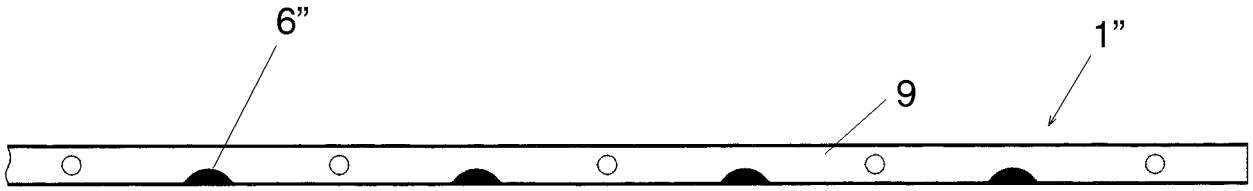
FIGS. 11-13 are schematic views showing a refrigerant distributor according to further embodiments of the present invention.
Figure 12:
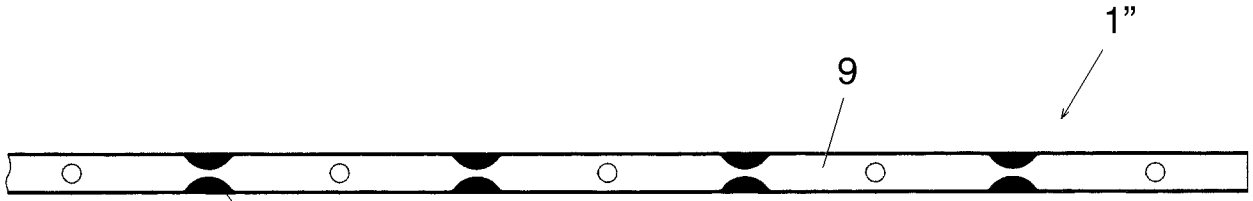
Figure 13:
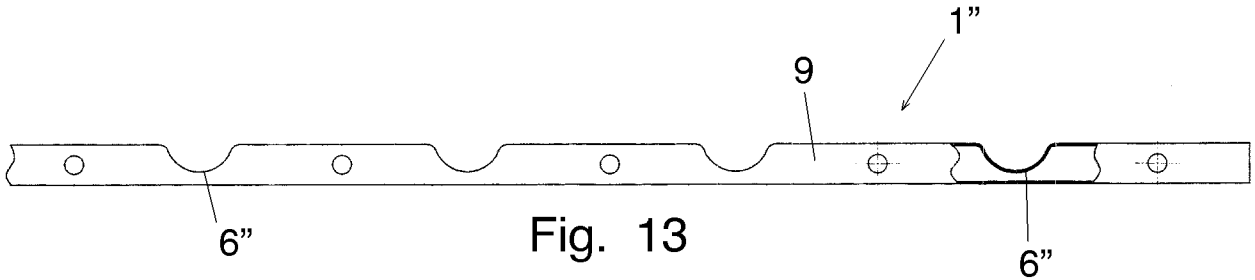

In addition, the embodiments have been described and shown for the purpose of explanation of the present invention, but should not be construed as limitation to the present invention. For example, distributors 1" according to further embodiments may be configured as shown in FIGS. 11-13, and the portions having reduced cross-section area of the distributors 1" may be formed by raised portions 6" projecting inward from an inner wall of the pipe 9 as shown in FIGS. 11-13. Each raised portion 6" may be formed at a complete inner perimeter of the inner wall of the pipe or at a part of the inner perimeter. For example, a wall of a pipe partially projects inward at a part of an outer perimeter of the pipe instead of the wall of the pipe projecting inward at the complete outer perimeter of the pipe. In addition, the portions having reduced cross-section area according to the present invention may be formed in other manners to generate turbulent flow of refrigerant or to mix refrigerant.

In the above embodiments, at least one portion having reduced cross-section area is located between both ends of the pipe. Alternatively, the portion having reduced cross-section area may be positioned at the end of the pipe where the inlet 7 is disposed, such that refrigerant supplied to the distributor through a piping can be mixed uniformly.

In addition, in the above embodiments, the portion having reduced cross-section area is described for mixing and distributing refrigerant. However, the portion having reduced cross-section area may be used to generate turbulent flow of refrigerant instead of distribution of refrigerant, or to mix refrigerant.

In addition, in FIGS. 3 and 7, the outlets 8 are disposed towards a direction perpendicular to the flat tubes 5 only for the purpose of illustration. However, the outlets 8 may be disposed towards any appropriate direction relative to the flat tubes 5.

The invention claimed is:

1. A refrigerant distributor for a heat exchanger, comprising:

a pipe for distributing a refrigerant, the pipe having a channel therein in which the refrigerant flows, wherein the channel has at least one portion having reduced cross-section area allowing refrigerant to pass therethrough, wherein the at least one portion having reduced cross-section area is disposed between a first end and a second end of the pipe, wherein the pipe has an inlet disposed at the first end of the pipe, whereby the refrigerant flows into the pipe through the inlet, the at least one portion having reduced cross-section area comprising a plurality of portions having reduced cross-section area, wherein distances between adjacent portions having reduced cross-section area of the plurality of portions having reduced cross-section area gradually increase in the refrigerant flow direction from the first end to the second end of the pipe, wherein at least one outlet is disposed between every two adjacent portions having reduced cross-section area of the plurality of portions having reduced cross-section area such that the refrigerant flows out of the pipe through the at least one outlet, and wherein the portions having reduced cross-section area of the plurality of portions having reduced cross-section area do not include any of the at least one outlets.

2. The refrigerant distributor for a heat exchanger according to claim 1, wherein the at least one portion having reduced cross-section area is a reducing segment formed by reducing a size of the pipe in a direction generally perpendicular to an axial direction of the pipe.

3. The refrigerant distributor for a heat exchanger according to claim 2, wherein the pipe is a cylindrical pipe and the size is a diameter.

4. The refrigerant distributor for a heat exchanger according to claim 1, wherein the at least one portion having reduced cross-section area is a flat segment formed by pressing the portion of the pipe to be flat.

5. The refrigerant distributor for a heat exchanger according to claim 1, wherein the at least one portion having reduced cross-section area is a reducing segment formed by pressing an outer peripheral surface of the portion of the pipe.

6. The refrigerant distributor for a heat exchanger according to claim 1, wherein the at least one portion having reduced cross-section area is formed by a raised portion projecting inward from an inner wall of the pipe.

7. The refrigerant distributor for a heat exchanger according to claim 1, wherein the pipe has a plurality of outlets through which the refrigerant flows out of the pipe, and the plurality of the portions having reduced cross-section area are disposed between every two adjacent outlets of the plurality of outlets.

8. The refrigerant distributor for a heat exchanger according to claim 1, wherein the pipe has a plurality of outlets through which the refrigerant flows out of the pipe, and two portions having reduced cross-section area are disposed between every two adjacent outlets of the plurality of outlets.

9. A heat exchanger, comprising:

a refrigerant distributor disposed at a side of the heat exchanger to distribute refrigerant, wherein the refrigerant distributor is the refrigerant distributor according to claim 1.

10. The heat exchanger according to claim 9, wherein the heat exchanger is a micro-channel heat exchanger.

11. The heat exchanger according to claim 9, wherein the at least one portion having reduced cross-section area in the channel of the distributor pipe is a reducing segment formed by reducing a size of the pipe in a direction generally perpendicular to an axial direction of the pipe.

12. The heat exchanger according to claim 9, wherein the at least one portion having reduced cross-section area in the channel of the distributor pipe is a flat segment formed by pressing the portion of the pipe to be flat.

13. The heat exchanger according to claim 9, wherein the at least one portion having reduced cross-section area in the channel of the distributor pipe is formed by a raised portion projecting inward from an inner wall of the pipe.

14. The heat exchanger according to claim 1, wherein at least one outlet is disposed between every two adjacent portions having reduced cross-section area of the plurality of portions having reduced cross-section area such that the refrigerant flows out of the pipe through the at least one outlet.

15. A heat exchanger compromising:

an inlet manifold having a refrigerant distributor disposed therein, the refrigerant distributor including:

a pipe for distributing a refrigerant, the pipe having a channel therein in which the refrigerant flows, wherein the channel has at least one portion having reduced cross-section area allowing refrigerant to pass therethrough, wherein the at least one portion having reduced cross-section area is disposed between a first end and a second end of the pipe, wherein the pipe has an inlet disposed at the first end of the pipe, whereby the refrigerant flows into the pipe through the inlet, the at least one portion having reduced cross-section area comprising a plurality of portions having reduced cross-section area, wherein distances between adjacent portions having reduced cross-section area of the plurality of portions having reduced cross-section area gradually increase in the refrigerant flow direction from the first end to the second end of the pipe, wherein at least one outlet is disposed between every two adjacent portions having reduced cross-section area of the plurality of portions having reduced cross-section area such that the refrigerant flows out of the pipe through the at least one outlet, and wherein the portions having reduced cross-section area of the plurality of portions having reduced cross-section area do not include any of the at least one outlets.

* * * * *